US010256565B2

(12) United States Patent
Kraemer et al.

(10) Patent No.: US 10,256,565 B2
(45) Date of Patent: Apr. 9, 2019

(54) POWER-ELECTRIC CONTACT DEVICE; EXCHANGEABLE POWER-ELECTRIC CONTACT MODULE AS WELL AS POWER-ELECTRIC CONNECTOR

(71) Applicant: TE Connectivity Germany GmbH, Bensheim (DE)

(72) Inventors: Peter Kraemer, Bensheim (DE); Dusan Ondrej, Heppenheim (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 15/467,655

(22) Filed: Mar. 23, 2017

(65) Prior Publication Data

US 2017/0279210 A1 Sep. 28, 2017

(30) Foreign Application Priority Data

Mar. 23, 2016 (DE) ..... 10 2016 105 470

(51) Int. Cl.

| | |
|---|---|
| ***H01R 13/03*** | (2006.01) |
| ***H01R 13/506*** | (2006.01) |
| ***H01R 13/11*** | (2006.01) |
| ***H01R 31/06*** | (2006.01) |
| ***H01R 13/434*** | (2006.01) |
| *H01R 105/00* | (2006.01) |

(Continued)

(52) U.S. Cl.

CPC ..... *H01R 13/506* (2013.01); *H01R 13/111* (2013.01); *H01R 13/434* (2013.01); *H01R 31/06* (2013.01); *H01R 4/56* (2013.01); *H01R 11/26* (2013.01); *H01R 13/53* (2013.01); *H01R 24/86* (2013.01); *H01R 2105/00* (2013.01)

(58) Field of Classification Search

CPC ..... H01R 13/02; H01R 13/10; H01R 13/502; H01R 4/16; H01R 13/516

USPC ..... 439/686, 650, 651, 518, 891

See application file for complete search history.

(56) References Cited

U.S. PATENT DOCUMENTS 1,583,697 A * 5/1926 Latham ..... H01R 13/2421 439/732

2,015,590 A * 9/1935 Cavanagh ..... H01R 27/00 439/168

(Continued)

FOREIGN PATENT DOCUMENTS

DE 3023232 A1 6/1980

DE 102011078348 A1 1/2012

(Continued)

OTHER PUBLICATIONS

DE Office Action issued in co-pending GB application 10 2016 105 470.4, dated Dec. 22, 2016, 6 pages.

(Continued)

*Primary Examiner* — Neil Abrams

(74) *Attorney, Agent, or Firm* — Barley Snyder

(57) ABSTRACT

A contact for an electrical connector having a connecting section a contact section. The connecting section has a connecting mounting member. The contact section has a contact mounting member engageable with the connecting mounting member of the connecting section. The contact section is separable from the connecting section, electrically connectable to the connecting section at a contact region, and detachably mechanically connectable to the connecting section at the contact region.

11 Claims, 3 Drawing Sheets

(51) Int. Cl.

| | |
|---|---|
| *H01R 4/56* | (2006.01) |
| *H01R 11/26* | (2006.01) |
| *H01R 13/53* | (2006.01) |
| *H01R 24/86* | (2011.01) |

(56) References Cited

U.S. PATENT DOCUMENTS 2,615,951 A * 10/1952 Klostermann ..... H01R 13/02 174/91
2,658,183 A * 11/1953 Klostermann ..... H01R 33/7664 174/50
2,716,737 A * 8/1955 Maberry ..... H01R 13/28 218/117
2,866,957 A * 12/1958 Raypholtz ..... H01R 13/621 439/246
2,869,091 A * 1/1959 Robards ..... B61G 5/10 174/126.1
2,904,771 A * 9/1959 Burtt ..... H01R 31/00 174/50.61
2,912,667 A * 11/1959 Sloat ..... H01R 31/00 439/651
2,962,688 A * 11/1960 Werner ..... H01R 13/5219 285/901
3,003,135 A * 10/1961 Purinton ..... H01R 13/642 439/843
3,210,720 A * 10/1965 Harris, Jr. ..... H01R 4/56 439/281
3,323,096 A * 5/1967 Appleton ..... H01R 13/621 439/320
3,375,481 A * 3/1968 Parnell ..... H01R 31/00 439/466
3,569,918 A * 3/1971 Arnold ..... H01R 13/02 439/733.1
3,721,943 A * 3/1973 Curr ..... H01R 13/426 439/273
3,748,632 A * 7/1973 Tanges, Jr. ..... H01R 13/18 439/686
3,763,460 A * 10/1973 Hatschek ..... H01R 13/533 439/277
3,771,110 A * 11/1973 Reed ..... B61G 5/10 439/271
3,897,131 A * 7/1975 Stauffer ..... H01R 13/41 439/444
3,996,546 A * 12/1976 Hugly ..... H01R 27/00 336/107
4,003,620 A * 1/1977 O'Brien ..... H01R 13/523 174/22 R
4,170,393 A * 10/1979 Mocek, Jr. ..... H01R 13/42 439/601
4,310,213 A * 1/1982 Fetterolf, Sr. ..... H01R 13/516 439/320
4,426,124 A * 1/1984 Vandevier ..... H01B 17/305 439/271
4,609,247 A * 9/1986 Annoot ..... H01R 13/5219 439/272
4,624,472 A * 11/1986 Stuart ..... B60D 1/62 138/115
4,758,175 A * 7/1988 Didier ..... H01R 13/5202 439/281
4,904,208 A * 2/1990 Powell ..... H01R 31/00 439/654
4,944,686 A * 7/1990 Gertz ..... H01R 4/5033 439/175
4,964,807 A * 10/1990 Draus ..... H01R 11/24 439/169
5,034,846 A * 7/1991 Hodge ..... H01R 13/6666 361/119
5,045,977 A * 9/1991 Cesar ..... H05K 9/0018 361/725
5,062,807 A * 11/1991 Guss, III ..... H01R 13/717 340/815.76
5,113,101 A 5/1992 Liu et al.
5,190,479 A * 3/1993 Jordi ..... H01R 13/6666 333/185
5,236,376 A * 8/1993 Cohen ..... H01R 13/7197 333/185
5,256,081 A * 10/1993 Didier ..... H01R 13/5202 439/274
5,358,433 A * 10/1994 Dechanteloup ..... H01R 13/111 439/843
5,362,258 A * 11/1994 Arnswald ..... H01R 13/521 439/271
5,439,391 A * 8/1995 McEtchin ..... A61N 1/3752 439/518
5,679,025 A * 10/1997 Barnes, Jr. ..... G02B 6/3807 385/72
5,890,930 A * 4/1999 Gerow ..... H01R 31/06 439/651
5,941,718 A * 8/1999 Didier ..... H01R 13/5202 439/170
6,042,428 A * 3/2000 Espiritu ..... H01R 13/506 439/686
6,077,132 A 6/2000 Gligorijevic
6,102,751 A * 8/2000 Becker ..... H01R 13/42 439/784
6,116,931 A * 9/2000 McCleerey ..... H01R 4/06 439/173
6,176,716 B1 6/2001 Mercurio et al.
6,278,284 B1 * 8/2001 Mori ..... G01R 1/0483 324/756.02
6,312,287 B1 * 11/2001 Harting ..... H01R 9/0515 439/581
6,328,615 B1 12/2001 Safai
6,450,833 B1 * 9/2002 Brown, Jr. ..... B60D 1/64 439/518
6,478,631 B1 * 11/2002 Dutton ..... H01R 13/506 439/607.06
6,629,853 B2 * 10/2003 Whiteman, Jr. ... H01R 13/6315 439/246
6,644,993 B2 11/2003 Victor
6,773,285 B2 * 8/2004 Bernat ..... H01R 13/6315 439/246
6,860,761 B2 3/2005 Lee et al.
6,945,822 B2 * 9/2005 Flemming ..... H01R 31/06 439/638
6,948,955 B2 * 9/2005 Ducrot ..... H01R 4/36 439/149
6,992,544 B2 * 1/2006 Barnes ..... H01P 5/085 333/260
7,029,327 B2 * 4/2006 Devine ..... H01R 13/521 439/587
7,097,469 B2 * 8/2006 Jacobs ..... H01R 13/11 439/246
7,207,844 B2 * 4/2007 Peng ..... H01R 13/64 439/173
7,329,156 B2 * 2/2008 Wells ..... H01R 13/20 439/738
7,513,038 B2 * 4/2009 Koh ..... H01R 13/6205 29/825
9,325,095 B2 * 4/2016 Glick ..... H01R 13/187
9,806,443 B1 * 10/2017 Thackston ..... H01R 12/585
2002/0048998 A1 * 4/2002 Fladung ..... H01R 31/06 439/651
2009/0253309 A1 * 10/2009 Didier ..... H01R 13/512 439/686
2014/0084678 A1 * 3/2014 Isaac ..... H01R 31/06 307/10.1
2015/0099385 A1 * 4/2015 Ikeya ..... H01R 12/724 439/271
2016/0190722 A1 * 6/2016 Nagasawa ..... H01R 13/405 439/660
2017/0279210 A1 * 9/2017 Kraemer ..... H01R 13/506

FOREIGN PATENT DOCUMENTS

DE 102014103864 A1 9/2015
EP 2854222 A1 4/2015

(56) References Cited

FOREIGN PATENT DOCUMENTS

| | | | |
|---|---|---|---|
| WO | 2004066453 | A1 | 8/2004 |
| WO | 2012151484 | A1 | 11/2012 |
| WO | 2013051529 | A1 | 4/2013 |

OTHER PUBLICATIONS

European search report, Application No. 17162288.9, dated Jul. 21, 2017, 15 pages.

* cited by examiner

POWER-ELECTRIC CONTACT DEVICE; EXCHANGEABLE POWER-ELECTRIC CONTACT MODULE AS WELL AS POWER-ELECTRIC CONNECTOR

CROSS-REFERENCE TO RELATED APPLICATION

This application claims the benefit of the filing date under 35 U.S.C. § 119(a)-(d) of German Patent Application No. 102016105470.4, filed on Mar. 23, 2016.

FIELD OF THE INVENTION

The present invention relates to a contact, and more particularly, to a contact of an electrical connector.

BACKGROUND

Known electrical connectors transfer electrical currents, voltages, signals, and data with a large bandwidth of currents, voltages, frequencies, and data rates. In low, medium, or high voltage or current ranges, and in particular in the automotive industry, such connectors must guarantee the transfer of electrical power, signals, and data in hot, contaminated, humid, or chemically aggressive environments. Due to the large range of applications, a large number of specifically configured connectors are known.

Known electrical connectors throughout the range of applications have housings assembled with an electrical member, such as an electrical cable or a circuit board of an electrical component, for mating with a mating electrical connector. An electrical connector must reliably secure an electrical contact within the housing for connecting to the electrical member. Furthermore, the electrical connector must reliably transmit electrical signals, and consequently, known electrical connectors have fasteners for releasably fastening to the mating electrical connector.

Electrical connectors used for charging electric vehicles require electrical contacts to transmit an electric current of approximately 32 A at outside temperatures of approximately −30° C. to approximately +50° C. and at a peak electric voltage of approximately 500 V. The service life of these charging connectors must be at least 10 to 15 years, wherein, depending on the environment (moisture, sand, salt etc.), it should be possible to carry out 10,000 to 20,000 plug connection cycles. In known charging connectors, in order to realize this number of plug connection cycles with low contact resistances, the contacts of the charging connectors have to be coated, which increases the manufacturing cost of the contacts.

SUMMARY

An object of the invention, among others, is to provide a contact for an electrical connector which is comparatively cost-effective to manufacture. A contact for an electrical connector according to the invention includes a contact section and a connecting section. The connecting section is separable from the contact section.

BRIEF DESCRIPTION OF THE DRAWINGS

The invention will now be described by way of example with reference to the accompanying Figures, of which.

DETAILED DESCRIPTION OF THE EMBODIMENTS

Figure 1:
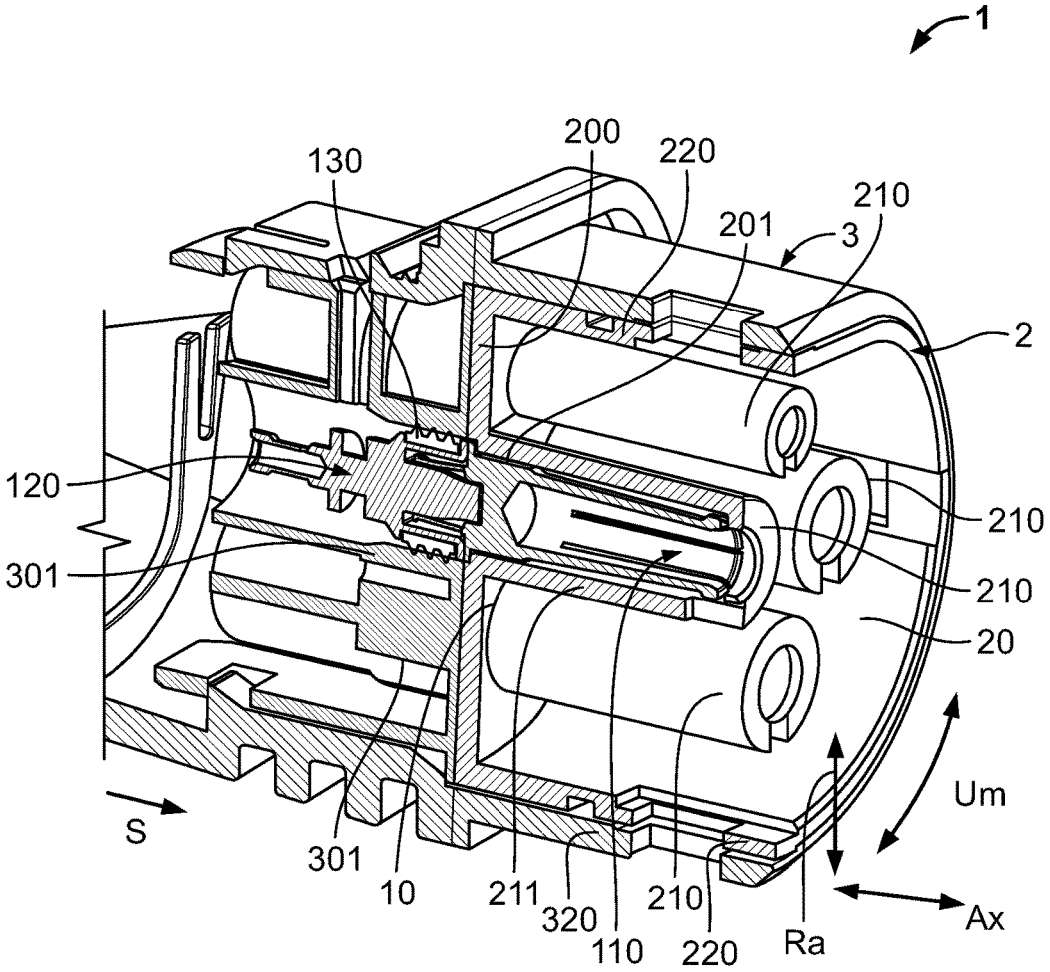
FIG. 1 is a sectional perspective view of a connector having a contact according to the invention.

Embodiments of the present invention will be described hereinafter in detail with reference to the attached drawings, wherein like reference numerals refer to like elements. The present invention may, however, be embodied in many different forms and should not be construed as being limited to the embodiments set forth herein; rather, these embodiments are provided so that the disclosure will be thorough and complete, and will fully convey the concept of the invention to those skilled in the art.

An electrical connector 1 having a contact 10 according to the invention is shown generally in FIG. 1. In the embodiment shown in FIG. 1, the connector 1 is a socket connector having a socket contact 10. In other embodiments, the connector 1 may be a plug connector matable with the socket connector 1 and having a plug contact 10 matable with the socket contact 10.

The contact 10, as shown in FIGS. 2-5, has a contact section 110 and a connecting section 120. The contact 10 is uncoated. In the shown embodiments, the contact section 110 and the connecting section 120 are formed from a copper alloy such as brass. In an exemplary embodiment, the contact section 110 and the connecting section 120 are formed from a copper alloy such as CuZn37Pb2 or CuZn35Pb2.

In the shown embodiments, and as described in greater detail below, the contact section 110 and the connecting section 120 are detachably mechanically connectable and electrically connectable with one another at a contact region 15. In other embodiments, the contact section 110 and the connecting section 120 may be integrally formed. The contact section 110 and the connecting section 120 extend in an axial direction Ax of the contact 10. Both the contact section 110 and the connecting section 120 are rotationally symmetric.

The contact section 110 has a contact mounting member 111 and the connecting section 120 has a connecting mounting member 121, as shown in FIGS. 2-5. To attach the contact section 110 to the connecting section 120, the contact mounting member 111 engages the connecting mounting member 121 at the contact region 15. The contact mounting member 111 and the connecting mounting member 121 are formed such that they can be engaged and disengaged numerous times.

Figure 2:
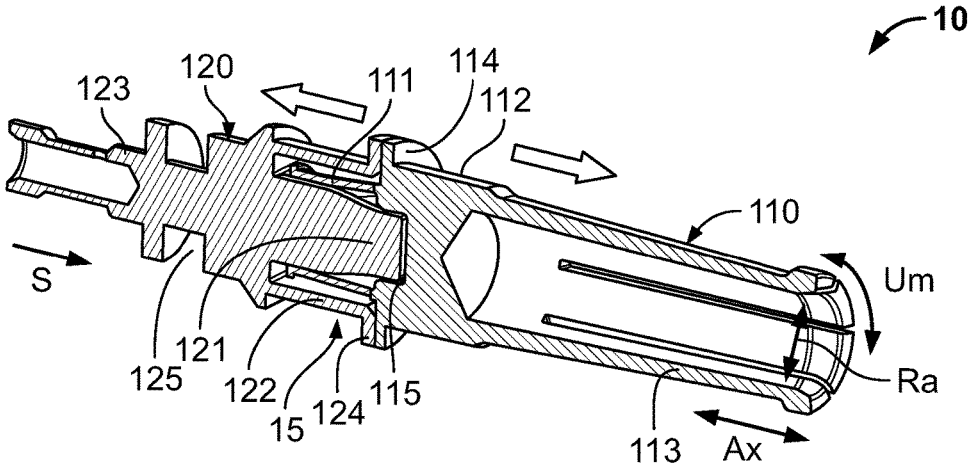
FIG. 2 is a sectional perspective view of the contact of FIG. 1 in a mounted state.
Figure 3:
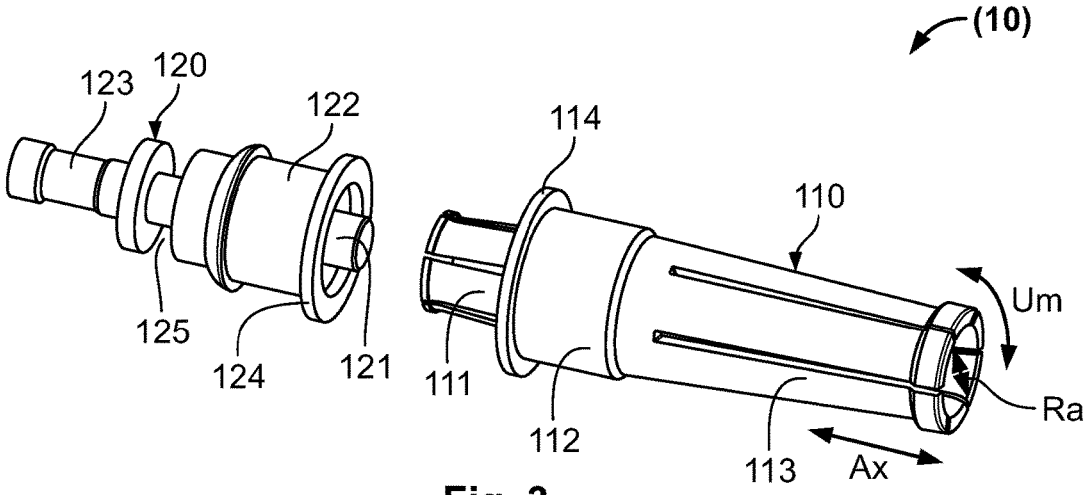
FIG. 3 is a perspective view of the contact of FIG. 1 in an unmounted state.

In the embodiment shown in FIGS. 2 and 3, the mounting members 111, 121 form a resilient plug connection; the contact mounting member 111 is a contact spring ring and the connecting mounting member 121 is a contact pin. In the embodiment shown in FIGS. 4 and 5, the mounting members 111, 121 form a screw connection; the contact mounting member 111 is an internally threaded recess and the connecting mounting member 121 is an externally threaded pin. In other embodiments, the mounting members 111, 121 may form a latching connection or a snap connection. In other embodiments, the contact mounting member 111 could be disposed on the connecting section 120, and the connecting mounting member 121 could be disposed on the contact section 110.

At least one of the contact section 110 and the connecting section 120 has a housing seat 112, 122, as shown in FIGS. 2-5, for mounting the contact 10 on/in a housing 3, 20. If there is only one housing seat 112, 122 on one of the contact section 110 and the connecting section 120, the other of the contact section 110 and the connecting section 120 is held at the housing 3, 20 by the first contact section 110 or connecting section 120. In the shown embodiment, the contact section 110 has a first housing seat 112 and the connecting section 120 has a second housing seat 122.

The contact section 110, as shown in FIGS. 2-5, has a contact region 113 disposed adjacent the first housing seat 112 at a longitudinal free end. In the shown embodiment, the contact region 113 is a socket contact region. In other embodiments, the contact region 113 may be a plug contact region.

The connecting section 120, as shown in FIGS. 2-5, has a connecting region 123 adjacent the second housing seat 122. In the shown embodiment, the connecting region 123 is a crimp region. In other embodiments, the connecting region 123 may be a welding region, a solder region, an adhesive region, a screw region, or a region forming other types of connections known to those with ordinary skill in the art. The connecting section 120 also has a fixing region 125 disposed between the connecting region 123 and the second housing seat 122.

The mounting members 111, 121, the housing seats 112, 122, the contact region 113, and the connecting region 123 of the contact section 110 and the connecting section 120, respectively, may be offset relative to one another in a radial direction Ra and overlap one another in the axial direction Ax, as shown in FIGS. 2-5. The mounting members 111, 121 are at an axial distance Ax from the respective housing seats 112, 122. Therefore, the mounting members 111, 121 are partially or substantially completely disposed within the housing seats 112, 122 of each of the contact section 110 and the connecting section 120.

A mounted state of the contact 10 is shown in FIGS. 1 and 2 and a demounted state of the contact 10 is shown in FIG. 3. A direction of attaching or mounting, or detaching or demounting, the contact section 110 to the connecting section 120 is shown by the arrows in FIG. 2. As shown in FIGS. 2 and 3, the connecting mounting member 121 extends out of the second housing seat 122. A free end of the connecting mounting member 121 engages a centering recess 115 of the contact section 110 in the mounted state. The centering recess 115 is disposed on an inside of the first housing seat 112.

Figure 4:
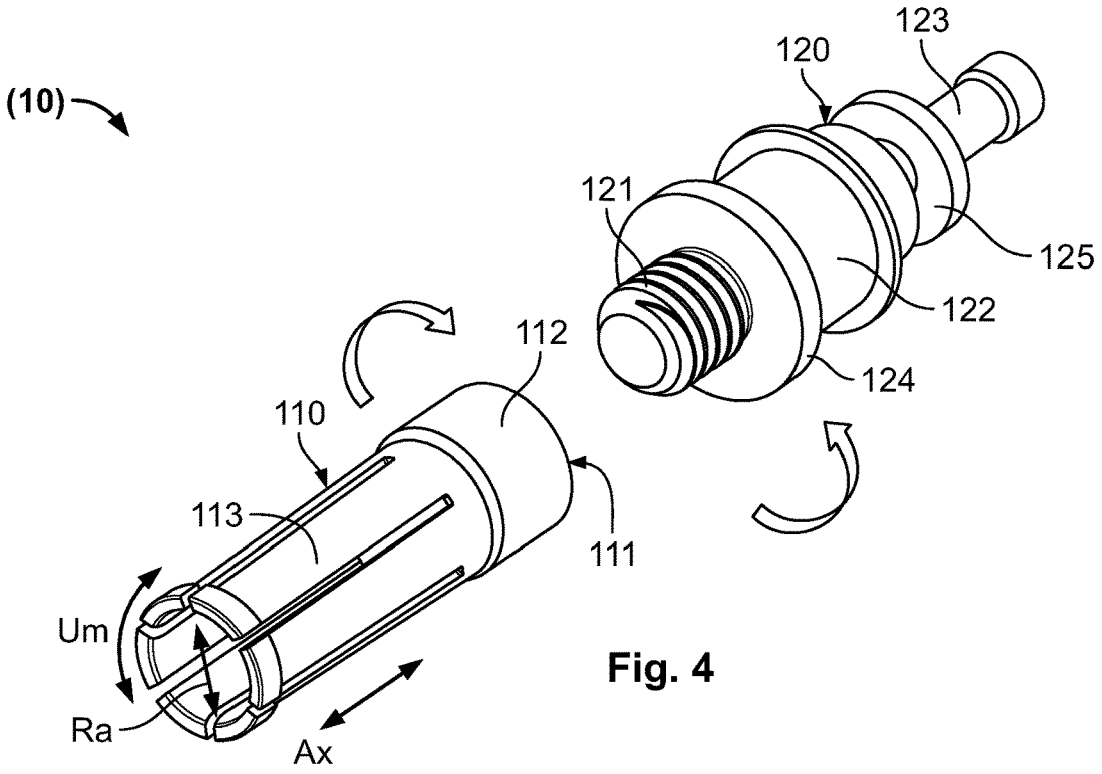
FIG. 4 is a perspective view of another contact according to the invention in an unmounted state.
Figure 5:
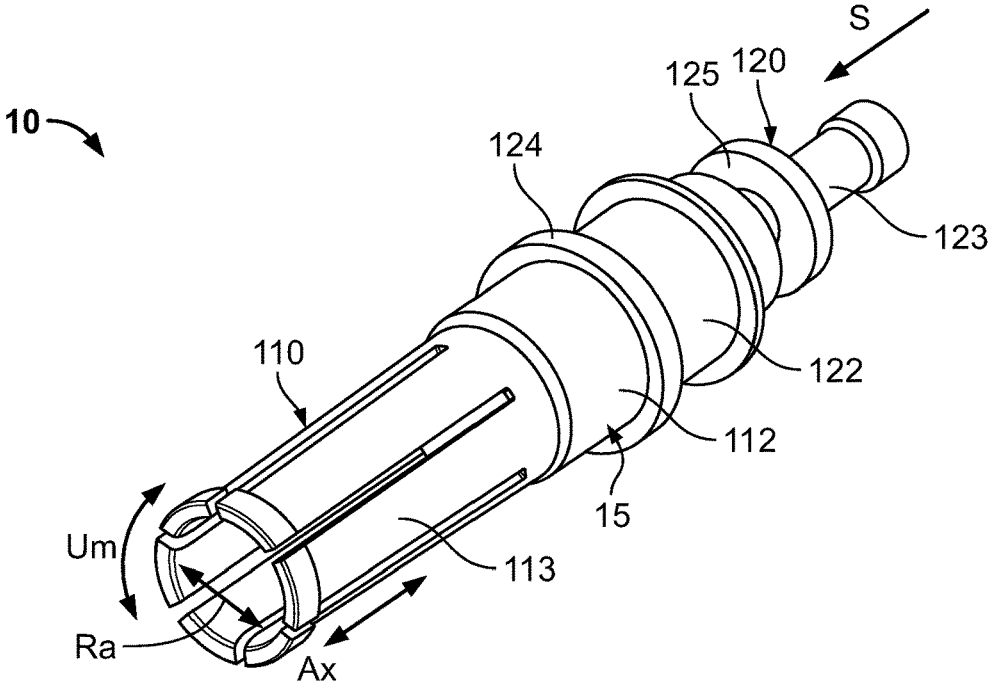
FIG. 5 is a perspective view of the contact of FIG. 4 in a mounted state.

In another embodiment of the contact 10 shown in FIGS. 4 and 5, a demounted state of the contact 10 is shown in FIG. 4, and a mounted state of the contact 10 is shown in FIG. 5. A direction of attaching or mounting, or detaching or demounting, the contact section 110 to the connecting section 120 is shown by the rotational arrows in FIG. 4.

The connector 1, as shown in FIG. 1, has a connector housing 3 in which a contact module 2 is removably disposed. The contact module 2 is shown in FIG. 1 in a mounted position in the connector housing 3. The contact module 2 has an insert housing 20 and the contact 10.

The insert housing 20, as shown in FIG. 1, has a base plate 200 formed in a disc-shape. The insert housing 20 is integrally formed. The base plate 200 has at least one contact section receptacle 201 for holding the contact section 110 of the contact 10. In the shown embodiment, the base plate 200 has a plurality of contact section receptacles 201 receiving a plurality of contact sections 110 of a plurality of contacts 10.

The contact section 110 is rotationally fixed within the contact section receptacle 201. A contact collar 114, disposed on an axial end of the contact mounting member 111 and shown in FIGS. 2-5, prevents the contact section 110 from being inserted too far into the insert housing 20. The contact collar 114 is disposed between the first housing seat 112 and the contact mounting member 111 of the contact section 110.

A protective sleeve 210, as shown in FIG. 1, extends away from the base plate 200. At least the contact region 113 of the contact section 110 is disposed in a contact region receptacle 211 of the protective sleeve 210, protecting a worker from contacting the contact section 110.

The base plate 200, as shown in FIG. 1, has a radial side wall 220 extending around the base plate 200 in a circumferential direction Um. The connector housing 3 has a circumferential cover 320 into which the insert housing 20 is inserted, and the cover 320 and side wall 220 have complementary releasable latching devices to fix the contact module 2 to the connector housing 3. The contact module 2 can be removed from the connector 1 and replaced by a second contact module 2 if, for example, the contact region 113 exhibits excessive wear. As a result, it is not necessary for the entire connector 1 to be replaced, but rather only a part thereof.

As shown in FIG. 1, the connecting section 120 of the contact 10 is held in a connecting section receptacle 301 of the connector housing 3. The connecting section 120 is rotationally fixed within the connecting section receptacle 301. A contact securing device of the connector housing 3 can engage the fixing region 125. The connecting mounting member 121, as shown in FIGS. 2-5, has a connecting collar 124 disposed at an axial free end of the connecting mounting member 121 at the second housing seat 122. The connecting collar 124 provides a stop for the contact collar 114 or for the first housing seat 112. The contact 10, as shown in FIG. 1, has a seal 130 disposed on the connecting section 120 at the second housing seat 122. The connecting collar 124 also provides an axial stop for the seal 130. The seal 130 seals the contact 10 with respect to the connector housing 3.

The connection region 123 of the contact 10 is crimped to a cable, such as a copper or aluminum cable. The contact 10 is suitable for voltages above 24 V, for example, approximately 500 V. The contact 10 is suitable for electric currents above 4 A, for example, approximately 32 A. The contact 10 is suitable for signals of above 500 mA, for example, approximately 2 A. The connector 1 having the cable and assembled contact 10 according to the invention may be used in the three-phase current sector or the electric vehicle sector.

What is claimed is:

1. A contact for an electrical connector, comprising:

a connecting section having a connecting mounting member, a second housing seat mountable at a connector housing, and a connecting collar disposed between the second housing seat and an end of the connecting mounting member; and a contact section:

(a) having a contact mounting member engageable with the connecting mounting member of the connecting section, a first housing seat mountable at a contact section receptacle of a contact module, and a contact collar disposed between the first housing seat and an end of the contact mounting member, (b) separable from the connecting section, (c) electrically connectable to the connecting section at a contact region, and (d) detachably mechanically connectable to the connecting section at the contact region, the connecting collar abutting the contact collar to provide a stop limiting insertion of the connecting mounting member into the contact mounting member along an axial direction of the contact.

2. The contact of claim 1, wherein the contact mounting member is a contact spring ring and the connecting mounting member is a contact pin.

3. The contact of claim 1, further comprising a seal disposed on the second housing seat.

4. The contact of claim 1, wherein the contact section and the connecting section are uncoated.

5. The contact of claim 1, wherein the contact section and the connecting section are formed from a copper alloy.

6. A contact module for an electrical connector, comprising:

an insert housing having a base plate having a plurality of contact section receptacles and a plurality of protective sleeves extending away from the base plate, one of the plurality of contact section receptacles disposed in each of the plurality of protective sleeves; and a plurality of contacts having a plurality of contact sections adapted to engage a plurality of mating contacts of a mating connector and a plurality of connecting sections separable from the contact sections, the plurality of contact sections disposed in the plurality of contact section receptacles, the plurality of protective sleeves only containing the contact sections.

7. The contact module of claim 6, wherein the base plate is formed in a disc-shape.

8. The contact module of claim 6, wherein the insert housing is integrally formed.

9. An electrical connector, comprising:

a connector housing having a connecting section receptacle;

a contact module including an insert housing having a contact section receptacle, the contact module is removably disposed in the connector housing; and a contact having:

a contact section disposed in the contact section receptacle and having a contact mounting member, a first housing seat mountable at the contact section receptacle, and a contact collar disposed between the first housing seat and an end of the contact mounting member; and a connecting section separable from the contact section and disposed in the connecting section receptacle, the connecting section having a connecting mounting member, a second housing seat mountable at the connector housing, and a connecting collar disposed between the second housing seat and an end of the connecting mounting member, the contact mounting member engageable with the connecting mounting member and the connecting collar abutting the contact collar to provide a stop limiting insertion of the connecting mounting member into the contact mounting member along an axial direction of the contact.

10. The contact of claim 1, wherein only the connecting collar and the contact collar are disposed between the first housing seat and the second housing seat in the axial direction when the connecting mounting member is inserted into the contact mounting member.

11. The contact of claim 1, wherein the connecting section has a connecting region and a fixing region, the fixing region disposed between the connecting region and the second housing seat and configured to engage a contact securing device of the connector housing.

* * * * *